US005249805A

United States Patent [19]

Neil et al.

[11] Patent Number: 5,249,805

[45] Date of Patent: Oct. 5, 1993

[54] BOARD GAME APPARATUS

[76] Inventors: Ambroz U. Neil, 27 Holmville Road, Higher Bebington, Wirral, Merseyside L63 2PU; Dwain A. Neil, 17 Sorrel Close, Huntington, Chester CH3 6SB, both of Great Britain

[21] Appl. No.: 571,637

[22] PCT Filed: Mar. 6, 1989

[86] PCT No.: PCT/GB89/00228

§ 371 Date: Oct. 31, 1990

§ 102(e) Date: Oct. 31, 1990

[87] PCT Pub. No.: WO89/07966

PCT Pub. Date: Sep. 8, 1989

[30] Foreign Application Priority Data

Mar. 4, 1988 [GB] United Kingdom ..... 8805226

[51] Int. Cl.[5] ..... A63F 3/00; A63F 9/24

[52] U.S. Cl. ..... 273/237; 273/271; 273/241; 273/138 A

[58] Field of Search ..... 273/271, 264, 241, 237, 273/138 A, 85 CP, 274

[56] References Cited

U.S. PATENT DOCUMENTS 3,819,186 6/1974 Hinterstocker ..... 273/138 A
4,181,308 1/1980 Fox et al. ..... 273/237

FOREIGN PATENT DOCUMENTS

WO82/01611 5/1982 PCT Int'l Appl. ..... 273/138 A
624305 7/1981 Switzerland ..... 273/274

*Primary Examiner*—Benjamin H. Layno
*Attorney, Agent, or Firm*—Anthony J. Casella; Gerald E. Hespos

[57] ABSTRACT

A board game apparatus is disclosed which comprises one or more playing surfaces divided into a plurality of sections. A plurality of tokens are used for temporarily marking any of the sections. An electronic random generator generates a reference symbol corresponding to any of the sections. In the preferred embodiment, there are three playing surfaces or tiers disposed at three different levels in a three-dimensional vertical array. The random number generator generates pairs of numbers which identify any particular section of any particular tier at random.

8 Claims, 4 Drawing Sheets

BOARD GAME APPARATUS

The present invention relates to board game apparatus.

Board ames commonly comprise a playing surface, divided in accordance with the nature of the game, which surface is marked or has counters or the like moved over it by the players. It is also known to provide a multi-tiered game board for three-dimensional games which have a plurality of playing surfaces disposed one above another in a vertical array. One such multi-tiered game board is that described in U.S. Pat. No. 3,884,474 which is for playing the well-known game of noughts and crosses or tic-tac-toe. The game board of the latter patent has at least three playing surfaces in a vertical stack, with the middle playing surface having at least three rank and at least three file rows and each upper and lower playing surface of the stack having one less rank and one less file row than the middle playing surface. It is also known to have a plurality of equally sized, square playing surfaces of equal rank and file numbers disposed in a vertical stack one above the other, the playing surfaces being supported in parallel, spaced apart positions by four pillars at the four corners of the stack, respectively.

Such board games, whether having a single or multiple playing surfaces, become predictable after regular use, since the playing strategies employed by the players are often repeated. The lifetime in which the game provides stimulating playing enjoyment is therefore strictly limited.

It would thus be advantageous if a board game apparatus could be provided which reduces considerably the likelihood of game playing becoming repetitious and boring.

In accordance with the present invention, there is provided a board game apparatus comprising at least one playing surface divided into a plurality of sections, each section having a unique locational identity, means for temporarily marking any of said sections, and a means for generating a reference identification corresponding to any of said sections which identifies that section in a manner which is functionally distinct from the location of that section itself.

Preferably the reference identification generating means comprises an electronically controlled generator which is housed on or within a base unit of the apparatus which supports said playing surface.

In a preferred embodiment the reference identification generating means is an electronic number generator.

Advantageously, the apparatus comprises a plurality of playing surfaces provided as tiered levels, the sections on each of which may be accessed easily by the players. In another embodiment, the playing surface may be planar but is marked so as to simulate a plurality of different playing levels. In either case, the electronic number generator may then generate two numbers, one number corresponding to the tier to be acted upon a player (or gives the player free choice of tier), and a second number corresponding to the section of that tier (or gives the player free choice of section).

The number of numbers can be generated on a purely random basis or may be biassable or weightable in favour of certain preselectable sections.

Preferably, the plurality of sections on the or each playing surface form a grid. The number of sections forming the length and the number of sections forming the width can be equal or different. In some embodiments, the number of tiers provided is equal to the number of sections forming the length or width of the grid.

In one embodiment of the present invention, each grid comprises a common "noughts and crosses" type pattern and has three tiered playing surfaces which provide a playing "volume" of twenty-seven sections, each tier measuring three sections in width, three sections in length.

In another embodiment, there may be included one or more additional playing surfaces disposed on the same level, so that several playing surfaces may be associated with a given level.

Preferably, the means for temporarily marking the playing surface sections comprises a plurality of tokens varying in shape, size, and/or colour, the tokens being adapted so that they may easily be placed on or removed from the appropriate section of the grid of a playing surface. Each player, by using any chosen strategy, attempts to form any one of a predetermined number of patterns of tokens upon the playing surfaces. On having formed such a pattern, that player may score a number of points which is related to the particular pattern of tokens formed by the player. However, the strategy employed by each player may be interrupted by activation of the means for generating a reference number corresponding to any particular section. Once a particular section is so "referenced", any pattern, having a token on that section as a constituent member thereof, is disrupted and so any strategy employed by a player is likewise disrupted and a new strategy must be chosen.

The invention is described further hereinafter, by way of example only, with reference to the accompanying drawings, in which.

Figure 1:
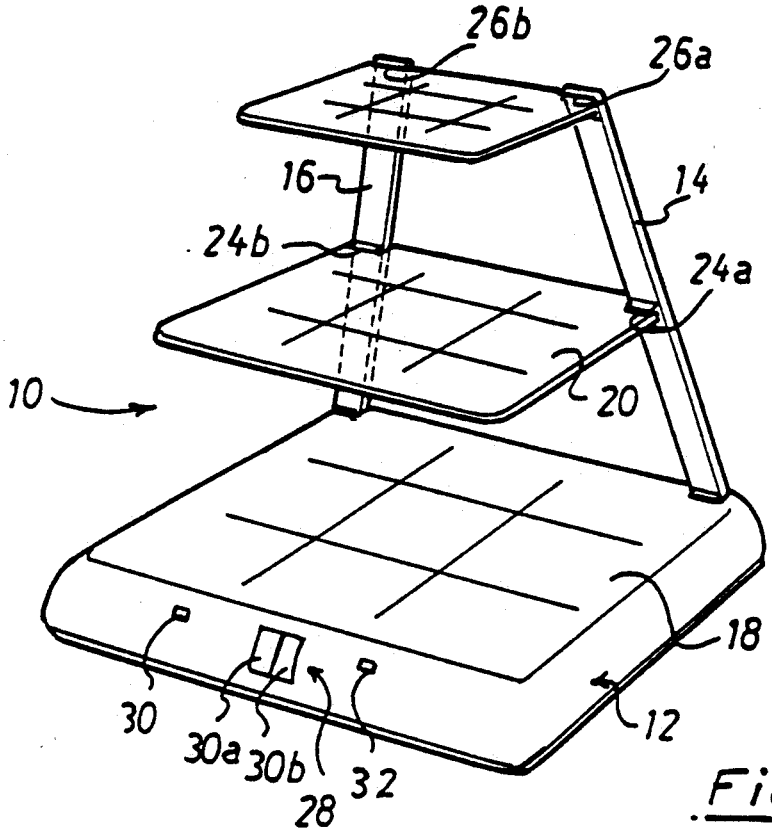
FIG. 1 is a perspective view of one embodiment of a board game apparatus in accordance with the present invention.
Figure 2:
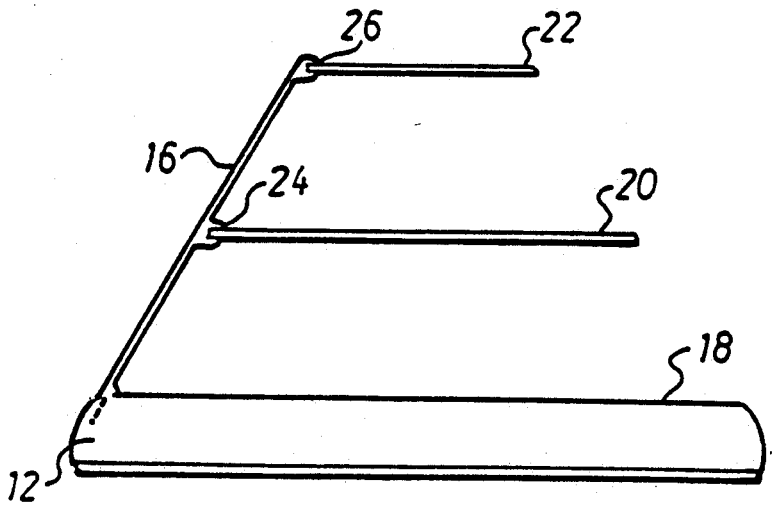
FIG. 2 is a side view of the apparatus of FIG. 1.

The board game apparatus of FIGS. 1 and 2 comprises a structure 10 having a substantially square base portion 12 with two support arms 14,16 extending upwardly therefrom. A first playing surface 18 is provided on the base portion 12 and second 20 and third 22 playing surfaces are attached to the support arms 14,16 so as to be disposed in tiered relationship in respective horizontal planes. The third playing surface 22 is of smaller size than and disposed above the second playing surface 20 which is of smaller size than and disposed above the first playing surface 18.

The second 20 and third 22 playing surfaces are preferably releasably secured to the support arms 14,16 which are also releasably secured to the base portion 12. As such the board structure 10 is easily disassembled so as to facilitate storage thereof.

In the illustrated embodiment, the releasability of the playing surfaces 20 and 22 from the support arms 14,16 is achieved by the formation on the support arms of pairs of integral slots *24a,24b* and *26a,26b* into which the playing surfaces are inserted with an interference fit. The support arms themselves are received in slots (not visible) in the base portion 12 which are orientated so that the arms assure the oblique attitude shown in FIGS. 1 and 2. The playing surfaces 20,22 can conveniently comprise respective planar sheets of a transparent plastics material. Likewise, the support arms 14,16 can be made of a rigid plastics material, which is preferably transparent.

The base portion includes a display panel 28 located on its front surface remote from the support arms 14,16. Also disposed on this front surface of the base portion, on the two sides of the display panel, respectively, are first and second push-button activation switches 30,32. The display panel includes, in this embodiment, two numeric displays **30*a*,30*b* for displaying respective numbers, as described hereinafter. The numeric displays 30*a*,30*b* preferably comprise liquid crystal numerical displays or light emitting diode numerical displays and are included so as to provide a visual output from electronic number generation circuitry located, along with a suitable power source, within the base portion 12. The activation switches 30*a*,30*b*** are used to operate the number generation circuitry.

As illustrated in FIG. 1, each of the playing surfaces 18,20,22 is provided with a "noughts and crosses" type grid and each section of the grid has a unique reference number identifying that section, which may or may not be physically marked on the playing surface itself. Each of the twenty-seven grid sections illustrated has a unique two-figure reference number, the first of which refers to the tier on which it is located, and the second of which identifies the particular section of that grid in that tier. One, **30*a*, of the two numerical displays 30*a*,30*b* is therefore used to indicate a number from zero to three to indicate the tier, and the other, 30*b***, of the numerical displays is used to indicate a number from zero to nine to indicate the particular section on that tier. The reason for including the number zero in each case will become apparent below.

The game apparatus also includes a plurality of counters or tokens, provided as sets, which sets differ either in shape, size or colour or in a combination of these characteristics. At the start of each game, each player has a predetermined number of tokens and, during the course of the game, attempts to place these tokens on unoccupied sections in a predetermined pattern upon the playing surfaces 18,20,22. Various permutations of pattern are possible and each corresponds to a number of points, which number of points is added to the score of the player forming that particular pattern. The game may be won on reaching a predetermined total of points or after a predetermined time period has expired.

During the course of the game, the number generating circuit located within the base portion 12 is activated by means of the activator switches 30,32 and a reference number corresponding to any one of the grid sections of any tier is displayed. In accordance with the rules of the game any token located on that reference grid section is removed and so any token pattern, of which that removed token was a constituent part, is disrupted.

The signal generating circuitry may generate and display a number of symbol purely randomly or, advantageously, be adjusted so that the probability of a particular section or sections being referenced is increased or reduced. If either or both of the numerical displays **30*a* or 30*b*** displays a zero then, in accordance with the rules of the game, the choice of tier and/or the grid section from which a token must be removed is made by one of the players, as described further hereinafter.

Figure 4:
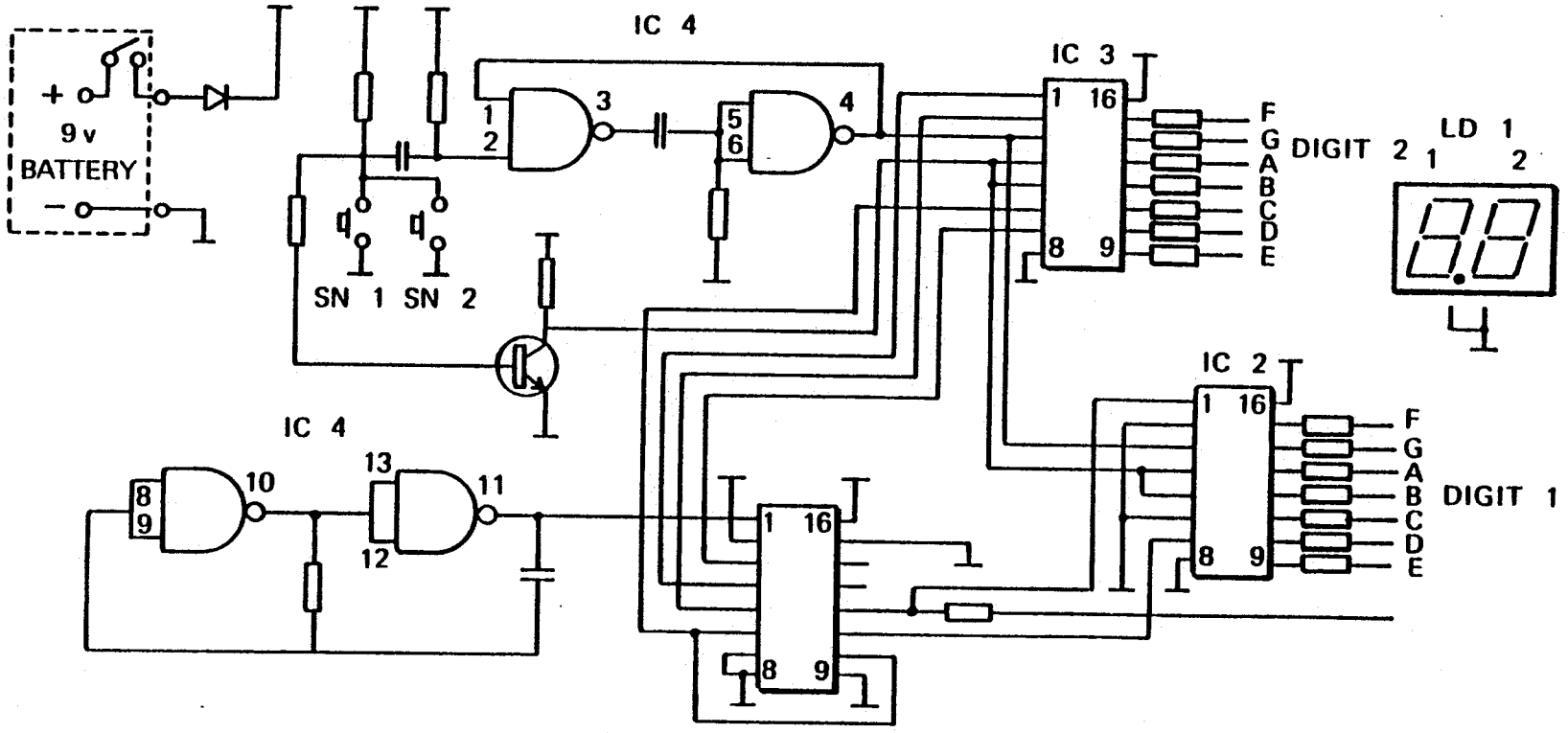
FIG. 4 is a circuit diagram of one possible embodiment of the electronic number generator and switching arrangement used in the embodiments of FIGS. 1, 2 and 4.

One possible example of the signal generation circuitry is shown in FIG. 4 to which reference is now made.

The random number generator circuit (FIG. 4) is based on a fast counter that, when disturbed by pushing one of the buttons 30,32 (SW1/SW2), is used to generate two digits on the digital display 28 (LD1).

The circuit is such that:

(1) When switched on, the decimal point on the digital dipslay (LD1) flashes and continues to do so irrespective of the pressing of SW1 or SW2 and whether or not digits are displayed on LD1.

(2) The electrical signal generated by the circuit is decoded and appropriately modified by IC1, IC2 and IC3 in order that digits can be displayed on LD1.

(3) The digits on LD1 range from 00 (zero-zero) through to 3 9 (three-nine) only in single digits.

(4) Digits are only displayed when either SW1 or SW2 are pressed. Once SW1 or SW2 are released, no digit is shown on LD1; the decimal point on LD1 however will continue to flash in a characteristic manner.

(5) Pressing SW1 or SW2 does not stop the counting circuitry, viz. whilst digits are displayed the circuit is still acting as a fast cycling counter but the electrical signals are not used.

The base portion 12 may also include a drawer (not shown) which may be used to house the counters or tokens, the second 20 and third 22 playing surfaces and the support members 14,16 to facilitate storage when the game is not being played. As illustrated in FIG. 1, the second 20 and third 22 playing surfaces are preferably transparent so that any three dimensional patterns of tokens is easily visible. The first playing surface 18 can also be transparent if desired. Also, the three playing surfaces 18,20,22 are well separated so as to allow easy access to the grids, particularly if more than two players are involved in the game, and especially if certain pairs of players are restricted to the use of only one of three playing axes (see FIG. 3 described hereinafter).

The three playing surfaces 18,20,22 are referred to as level 1, level 2 and level 3 respectively and the sections of the "noughts and crosses" type grid are numbered 1 to 9 such that, for example, the section in the left top corner of playing surface 22, (as in FIG. 1), has a reference "level 3 square 1" and would be indicated by the number generator display as 3,1.

On starting a typical game, each player generates a number via the number generator and the player generating the highest number has the choice whether to make he first move or not. Once decided, the player taking the first turn, places a token on any section of the grid on any of the three playing surfaces. Before the next player takes a turn at placing a token on any of the free sections of the playing surfaces, (no section can have more than one token on it), the number generator is activated so as to produce a reference number corresponding to one of the twenty seven playing sections available. Such a number is generated after each player takes a turn of placing tokens on the playing surfaces and if when a particular reference number is generated that number corresponds to a section with a token located on it, that token is removed.

If the number generator generates a zero for either the level/section to be acted on, the player whose turn follows, has a choice of which level/section is to have a token removed therefrom, should a token be located at that particular section. If both numbers generated are a zero, than that player has the complete choice as to which of the sections may be acted on so as to remove a token therefrom.

Once a player has placed three identical tokens in either of a horizontal, vertical or diagonal line and if the following activation of the number generator does not generate a reference number that disrupts the pattern, the game is ended and the points scored corresponding to the existing pattern of tokens for each player are noted. A typical point structure is illustrated below:

| | |
|---|---|
| for stopping the game | 2 points |
| for three majority tokens in a row | 2 points |
| for three minority tokens in a row | 5 points |
| for two majority and one minority tokens is a row | 10 points |
| for two minority and one majority tokens is a row | 15 points |

The reference to minority and majority tokens occurs since each player may possess a large number of one colour or type of token and also a small number of another colour or type of token. The overall winner is the player with the most points after a predetermined time period has elapsed or after a predetermined number of games have been completed, or a predetermined number of points has been scored.

There are a number of variations possible with respect to the main theme of the game as outlined hereinabove, some of which are outlined below.

A "Junior Level-3" version is designed for two players using the board apparatus of FIGS. 1 and 2, each player having a set of fifteen tokens comprising nine of one type and six of another in which the sets belonging to each player are easily distinguished. Once each player's supply of 15 tokens is exhausted and the game is ended, the scores corresponding to the particular patterns formed are noted, and the player with the most points is declared the winner.

The "Level-3" version is designed for two players, each of which is allocated six tokens of one colour/type and four of another colour/type. At the start of the game each player has six tokens, three of each colour/type, and the remainder are available as a reserve. If a player has a token removed from any playing section as a result of the reference number produced by the number generator, then the opponent gains a token from the stock of that player's reserves, where they exist. The number generator may also be set to provide a "skewed number distribution" in favour of, for example, level 2 section 5, i.e. the middle section of the middle surface. If a player's supply of tokens is completely exhausted, (i.e. they are in the reserve stock and/or on sections), the number generator is activated so as to attempt to win tokens from the reserve stock. As previously, the player with most points after a predetermined number of games, or a predetermined time limit, or the first to reach a predetermined number of points, is declared the winner.

Figure 3:
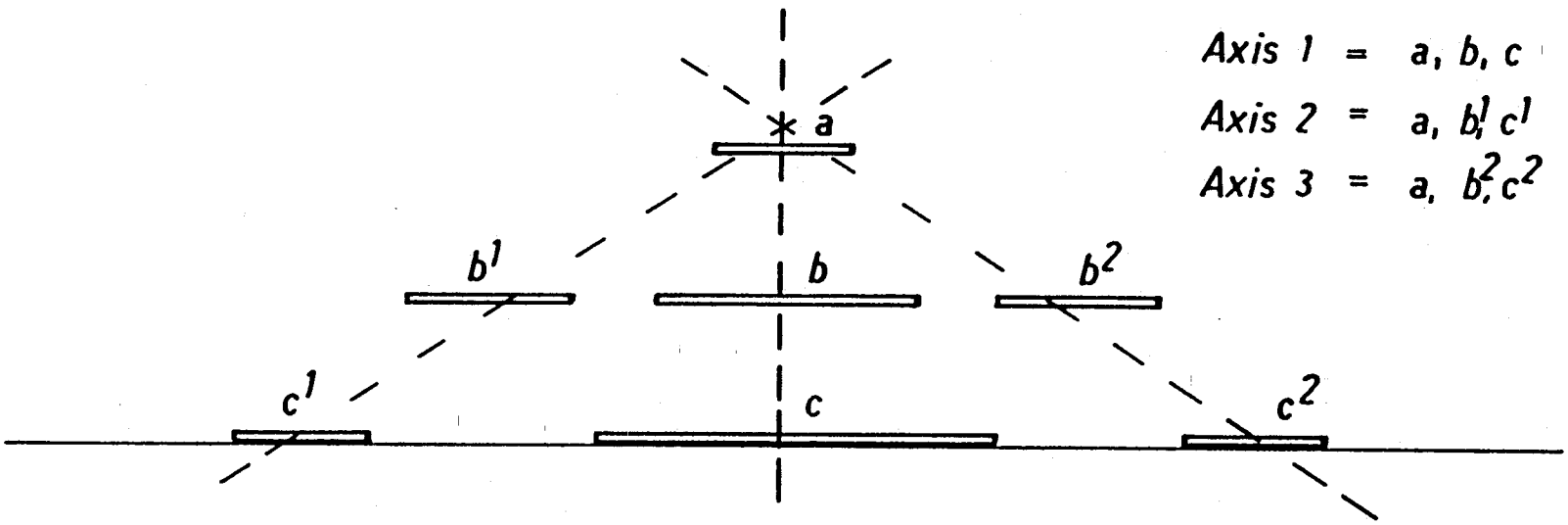
FIG. 3 is a diagrammatic side view of a second embodiment in accordance with the invention.

The "Family Level-3" version is designed for six players and is played on a modified apparatus, such as that shown in FIG. 3. The apparatus of FIG. 3 has three stacked playing surfaces as before, marked a, b and c. Disposed on two opposite side of surface b are two further playing surfaces $b^1$ and $b^2$. Disposed on two opposite sides of playing surface c are two further playing surfaces $c^1$ and $c^2$. The playing surfaces $b^1$, $c^1$, $b^2$, $c^2$ are positioned as shown so as to lie on different playing axes $a,b^1,c^1$ and $a,b^2,c^2$. A third axis is a,b,c corresponding to that of the first embodiment. The playing surfaces are divided up into sections as before.

In the "Family Level-3" version, the players are divided into three pairs and each pair is restricted to playing on a particular one of the three axes of FIG. 3. At the start of each game each player has six tokens, three of each colour/type, and the remainder are available as a reserve. This game could be stopped when all tokens are exhausted and the game is ended. In order to stop the game before the tokens are exhausted, a player must have a token in place on level B before completing a line of three identical tokens and this line is not disrupted by the next number generated by activating the number generator. Obviously, in this embodiment the number generator must be capable of identifying a greater number of sections than in the first embodiment. Tokens removed during this game do not generate a token for the opponent. The generator may be switched so as to provide a skewed number distribution in favour of level 2 section 5. In a further version of "Family Level-3", when a particular player's token is removed as a result of the number generator, each of the other players gains a token from their own token reserves, where they exist.

The "Genius Level-3" version is designed for up to six players and is again played on an apparatus such as that shown in FIG. 3. Each of the grids on the second and third levels are divided into a "left set", a "centre set" and a "right set", as viewed in FIG. 3, or first and second levels can be regarded as extended levels, each of twenty-seven sections. On the number generator referencing any section in any axis, a token on this section and on the equivalent section in the other axes are removed, if present. When one player's token is removed each of the other players gains a token from their stock of reserves, where they exist. A biassed number generation in favour of any section of any level may be provided. In order to stop the game a player must have a token on level 3 before forming a row of three similar tokens. To maximise playing enjoyment, all the available tokens should be divided between all the players so that full usage of the playing space is possible. For example, if six players are involved, $6\times10$ tokens are used, if four players are involved, $4\times15$ tokens are used, and so on. In addition, a time limit may be provided in which a player must make a move. Failure to make a move within the time limit results in the removal of one of that player's tokens, and also in the opponents each gaining a token from the reserves, where they exist.

In an alternative, simpler game apparatus, the second and third tiers 20,22 and the support arms 14,16 can be dispensed with altogether and the game played on the base playing surface 18 alone. In this case, the number generator need only generate a single number in order to identify any particular section of the playing surface. However, in practice, such an embodiment may still be fitted with the double display so that it can be converted easily to multiple-tier operation.

Figure 5:
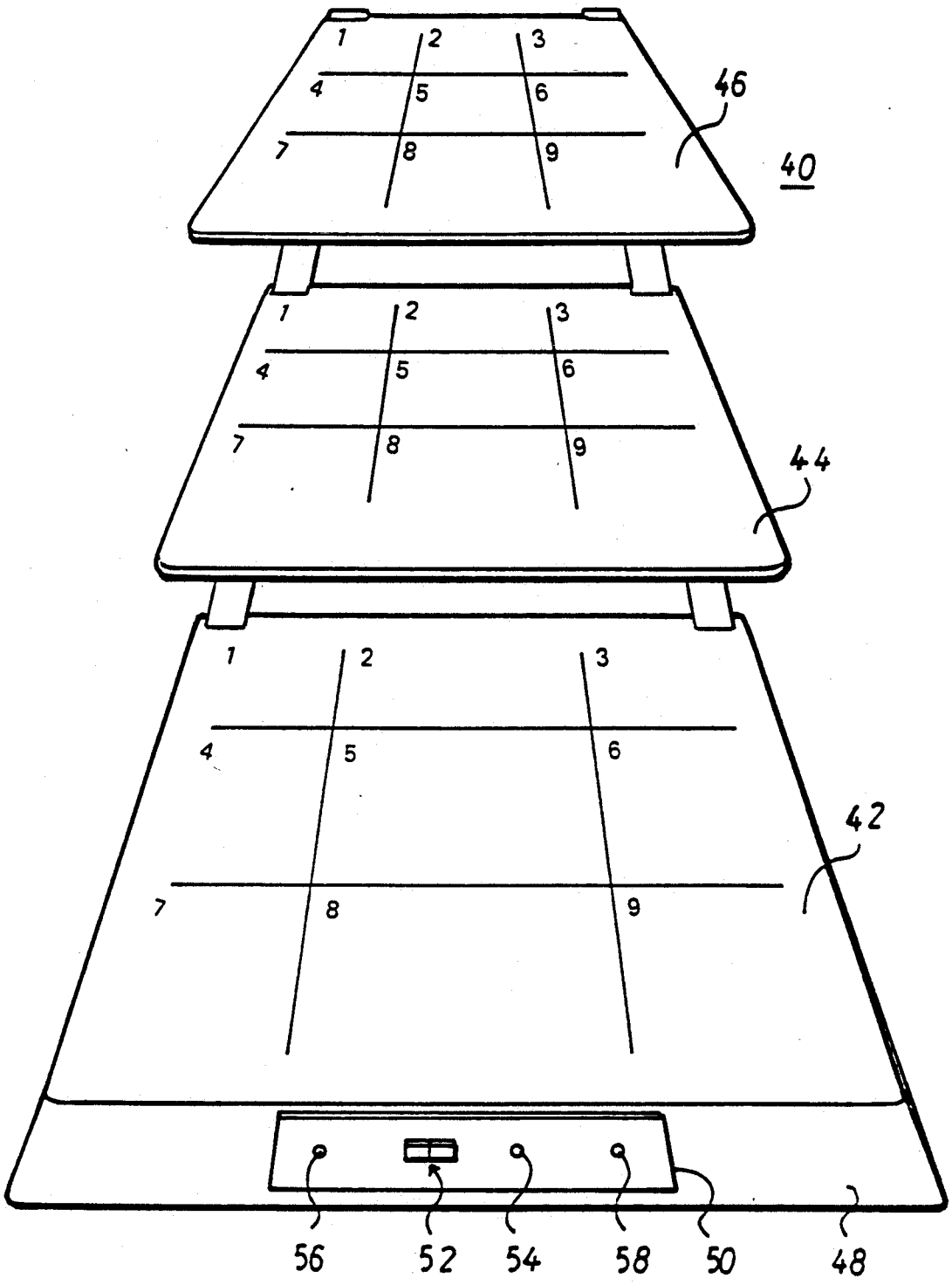
FIG. 5 is a plan view of a third embodiment in accordance with the invention.

A still further embodiment, illustrated in FIG. 5 simulates the presence of three tiers graphically on a planar base board 40. Thus, there is illustrated on the planar base board 40 first, second and third tiers 42,44,46 on which the abovementioned games can be played in the same manner as before. Mounted on the base board 40 at a position corresponding to the illustrated location of the base portion 48 of the simulated apparatus in a housing in the form of a rectangular box 50 which carries a numeric display 52 and two activation buttons 54,56 as before. Located within the box 50 is an electronic number generator and power supply as in the case of the three-dimensioned version of FIGS. 1 and 2. The box 50 also carries a power on/off switch 58.

The invention is not restricted to the details of the foregoing embodiments. For example, any number of playing surfaces may be provided, which surfaces may include a grid having any number of sections. Also, any type of suitable support structure may be used, when more than one playing surface is provided for the game. The playing surfaces may also be coloured and be provided horizontally or inclined to the horizontal. Further number display panels and activators may be provided on another side or sides of the apparatus of FIG. 1 and/or can be located on free-standing control panels separate physically from the main base portion or attached to any other level or the supports.

The rules of play may be suitably modified as desired.

Although the symbol/number generating circuitry can be embodied in any suitable manner, in one advantageous embodiment appropriate circuitry is formed on a microchip. The microchip may, for example, be designed so as to produce a bias over a period of time, in favour of one or more of the sections or levels. This bias may be cyclic or random as desired. Such possibilities permit opportunities to create different environments against which the game progresses and which can therefore enhance the long-term appeal of the game.

We claim:

1. A board game apparatus comprising at least one playing surface divided into a plurality of sections, each section having a unique locational identity, and means for temporarily marking any of said sections, characterized by a means for generating a reference identification corresponding to any of said sections which identifies that section in a manner which is functionally distinct from the location of that section itself;

wherein the reference identification generating means is housed in a base unit of the apparatus which supports said at least one playing surface;

the reference identification generating means includes at least one display panel on said base unit which provides a visual identification of any section to be identified by said reference identification generating means;

said base carries at least one push button for initiating selection of a section by said reference identification generating means; and comprising a plurality of playing surfaces disposed as tiered levels in a vertical array.

2. A board game apparatus as claimed in claim 1, wherein the reference identification generating means is an electronic number generator.

3. A board game apparatus as claimed in claim 2, wherein said electronic number generator is a random number generator.

4. A board game apparatus as claimed in claim 2, wherein the number generator includes means for preselecting one or more numbers which are generated more frequently than others whereby the likelihood of those numbers being generated is weighted.

5. A board game apparatus as claimed in claim 1, wherein there are three playing surfaces in the array, second and third playing surfaces being mounted above a first playing surface on the base unit by means of a collapsible support structure.

6. A board game apparatus as claimed in claim 5, wherein the support structure comprises a pair of support arms selectively connectible to the base unit so as to extend upwardly and obliquely from two adjacent corners of the base unit, the second and third playing surfaces being contained on respective transparent planar boards which are selectively connectible to said support arms so as to lie in respective parallel horizontal planes above the base unit.

7. A board game apparatus as claimed in claim 1, wherein the plurality of sections on the or each playing surface form a grid in the form of a "noughts and crosses" type pattern.

8. A board game apparatus as claimed in claim 1, wherein there is a single playing surface on which is illustrated graphically a number of tiered playing levels so as to simulate in two dimensions the playing of the game in three dimensions.

* * * * *